US008087228B2

(12) United States Patent
McMahan et al.

(10) Patent No.: US 8,087,228 B2
(45) Date of Patent: Jan. 3, 2012

(54) SEGMENTED COMBUSTOR CAP

(75) Inventors: Kevin Weston McMahan, Greer, SC (US); John Charles Intile, Simpsonville, SC (US); Shiva Srinivasan, Greer, SC (US); Sergey Alexandrovich Stryapunin, Moscow (RU)

(73) Assignee: General Electric Company, Schenectady, NY (US)

( * ) Notice: Subject to any disclaimer, the term of this patent is extended or adjusted under 35 U.S.C. 154(b) by 749 days.

(21) Appl. No.: 12/208,906

(22) Filed: Sep. 11, 2008

(65) Prior Publication Data

US 2010/0058766 A1 Mar. 11, 2010

(51) Int. Cl.
*F02C 3/00* (2006.01)

(52) U.S. Cl. ..... 60/39.37; 60/752

(58) Field of Classification Search ..... 60/39.37, 60/733, 746, 747, 752, 800; 431/8, 159, 431/174, 278, 285

See application file for complete search history.

(56) References Cited

U.S. PATENT DOCUMENTS

| | | | | |
|---|---|---|---|---|
| 4,967,561 | A * | 11/1990 | Bruhwiler et al. | 60/737 |
| 5,274,991 | A * | 1/1994 | Fitts | 60/800 |
| 5,357,745 | A | 10/1994 | Probert | |
| 6,547,256 | B2 * | 4/2003 | Aksit et al. | 277/628 |
| 7,010,921 | B2 | 3/2006 | Intile et al. | |
| 7,082,766 | B1 | 8/2006 | Widener et al. | |
| 7,140,189 | B2 * | 11/2006 | Markarian et al. | 60/796 |
| 7,461,509 | B2 | 12/2008 | Mick et al. | |
| 2008/0053097 | A1 * | 3/2008 | Han et al. | 60/737 |
| 2009/0188255 | A1 * | 7/2009 | Green et al. | 60/737 |
| 2009/0293489 | A1 * | 12/2009 | Tuthill et al. | 60/752 |

* cited by examiner

*Primary Examiner* — Louis Casaregola
*Assistant Examiner* — Phutthiwat Wongwian
(74) *Attorney, Agent, or Firm* — Nixon & Vanderhye P.C.

(57) ABSTRACT

A combustor cap is cooperable with an impingement plate in a turbine fuel nozzle and includes a plurality of cap segments independently securable to the impingement plate. The plurality of cap segments are radially and tangentially movable relative to the impingement plate.

9 Claims, 1 Drawing Sheet

SEGMENTED COMBUSTOR CAP

BACKGROUND OF THE INVENTION

This invention relates to gas and liquid fueled turbines, and more specifically, to combustors in industrial gas turbines used in power generation plants.

Gas turbines generally include a compressor, one or more combustors, a fuel injection system and a turbine. Typically, the compressor pressurizes inlet air which is then turned in direction or reverse flowed to the combustors where it is used to cool the combustor and also to provide air to the combustion process. In a multi-combustor turbine, the combustors are located about the periphery of the gas turbine, and a transition duct connects the outlet end of each combustor with the inlet end of the turbine to deliver the hot products of the combustion process to the turbine.

Combustor cap assemblies have evolved over the years from a single fuel nozzle configuration to a multi-nozzle dry low NOx configuration with independent fuel control to each or groupings of the fuel nozzles. This independent fuel control helps to ensure stable combustion over the operating range. The function of the cap is to serve as a physical buffer between the downstream burning zone and the upstream area prior to the fuel and air being mixed. Air and fuel pass axially through each fuel nozzle. Air also passes through multiple apertures in the cap effusion plate thereby cooling the plate.

Current cap designs are subject to thermal fatigue and subsequent cracking, sometimes leading to liberation of pieces of the cap and damage to the hot gas path. Additionally, this cracking is a source of repair cost. It would be desirable to eliminate the cracking of the effusion plate, thereby eliminating or reducing repair costs of the cap and eliminating or reducing the risk of damage to the downstream hot gas path components. Additionally, it would be desirable to utilize the cap as a resonator to thereby decrease the amplitude of combustion dynamics.

BRIEF DESCRIPTION OF THE INVENTION

In an exemplary embodiment, a combustor cap assembly includes an impingement plate with a plurality of primary fuel nozzle openings arranged in a circular array about a center opening, and a combustor cap secured to the impingement plate. The combustor cap includes a plurality of cap segments independently secured to the impingement plate. The plurality of cap segments are secured in such a way as to allow the cap segment edges to be radially and tangentially movable relative to the impingement plate.

In another exemplary embodiment, a combustor cap is cooperable with an impingement plate in a turbine fuel nozzle and includes a plurality of cap segments independently securable to the impingement plate. The plurality of cap segments are radially and tangentially movable relative to the impingement plate.

In still another exemplary embodiment, a combustor cap assembly includes an impingement plate with a plurality of primary fuel nozzle openings arranged in a circular array about a center opening, and a combustor cap secured to the impingement plate. The combustor cap includes nozzle openings aligned with the plurality of primary fuel nozzle openings in the impingement plate. The cap nozzle openings have a collar extending through the plurality of primary fuel nozzle openings in the impingement plate, where the combustor cap comprises a plurality of cap segments independently secured to the impingement plate, and where the plurality of cap segments are secured such that cap segment edges are radially and tangentially movable relative to the impingement plate. The assembly additionally includes a connector secured to the collar of the cap nozzle openings securing the plurality of cap segments to the impingement plate. The connector securing the plurality of cap segments to the impingement plate is the only rigid attachment between the plurality of cap segments and the impingement plate.

DETAILED DESCRIPTION OF THE INVENTION

Figure 1:
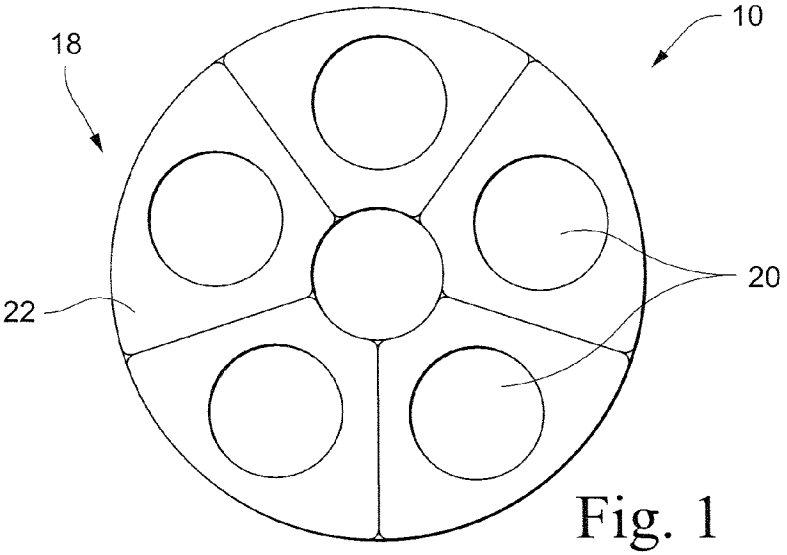
FIG. 1 is a plan view of the segmented combustor cap.
Figure 2:
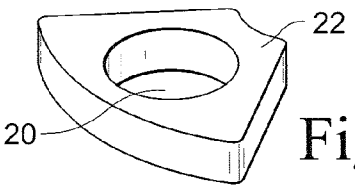
FIG. 2 is a perspective view of a single cap segment.

With reference to the drawings, a combustor cap assembly 10 includes an impingement plate 12 with a plurality of primary fuel nozzle openings 14 arranged in a circular array as shown about a center opening 16.

A combustor cap 18 is affixable to the impingement plate 12 and includes nozzle openings 20 that align with the primary fuel nozzle openings 14 in the impingement plate 12. In a preferred embodiment, the combustor cap 18 is constructed of a plurality of cap segments 22 preferably shaped as arc segments arranged in a circular array when secured to the impingement plate 12. The cap segments 22 are independently secured to the impingement plate 12. This keeps the cap segments 22 in intermittent contact with the impingement plate 12 without constraining the edges of the cap segments 22 from moving radially and tangentially in the plane of the impingement plate 12.

Figure 3:
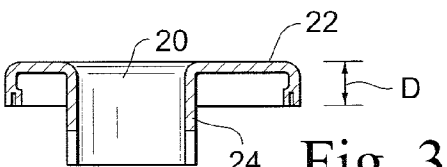
FIG. 3 is a cross sectional view of a cap segment.
Figure 4:
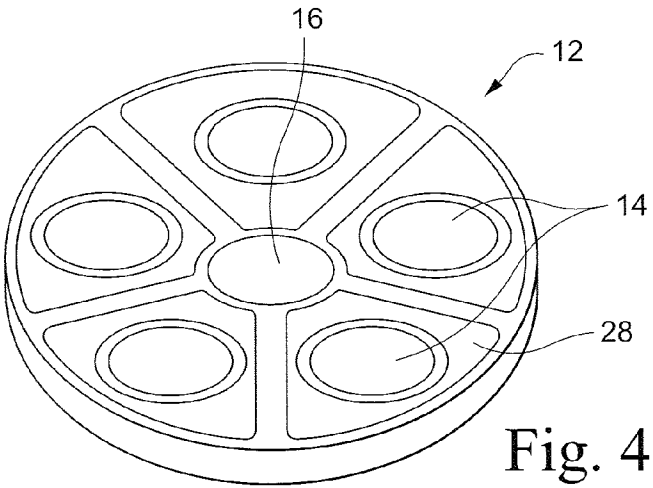
FIG. 4 is a perspective view of an impingement plate.
Figure 5:
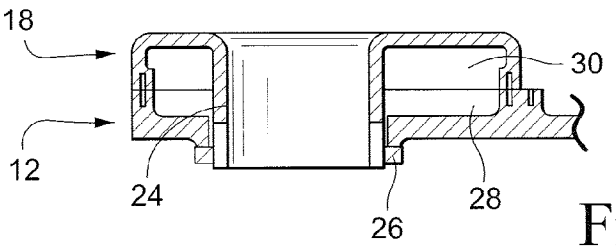
FIG. 5 is a cross sectional view of a cap segment assembled to the impingement plate.

With particular reference to FIGS. 3 and 5, the nozzle openings 20 of each cap segment 22 include a collar 24 extendible through the primary fuel nozzle openings 14 in the impingement plate 12. An integral piece or extension of the collar 24 is threaded, and at least the threaded portion of the collar 24 extends through the impingement plate 12 as shown in FIG. 5. A connector 26 such as a nut or the like is threaded on the collar 24 to secure the cap segment 22 to the impingement plate 12. The connector 26 securing the cap segments 22 to the impingement plate 12 serves as the only rigid attachment between the cap segments 22 and the impingement plate 12. Although in the preferred embodiment, the distal end of the collar 24 includes threads to receive a nut 26, other connectors may be suitable, and the invention is not necessarily meant to be limited to the illustrated threaded connection.

A depth D (FIG. 3) of each cap segment 22 may be cooperable with recesses or standoffs 28 in the impingement plate 12 to define a volume 30 between the impingement plate 12 and each of the cap segments 22. The volume 30 along with the diameters of the holes in the impingement plate 12 and the cap segments 18 can be used to form an acoustic resonator to decrease the amplitude of single or multiple combustor frequencies. Combustion acoustic instabilities are caused by an additive or reinforcing interaction between fluctuations in flame heat release and fuel flow. The heat release fluctuation causes pressure waves within the combustor, varying the pressure ratio across the fuel flow orifices in the fuel nozzle, leading to fluctuations in fuel flow, and driving further fluctuations in heat release. Resonators function as acoustic dampers by absorbing the energy of these pressure waves, thereby reducing the amplitude of the pressure waves and reducing or eliminating the fluctuations in fuel flow and heat release. This allows the resonator to detune or decouple the fuel flow fluctuations from the heat release fluctuations and thereby suppress the instability.

By segmenting the high temperature portion of the cap assembly and mounting these segmented flow path pieces to a backing structure that also forms the impingement plate, thermal stresses in the combustor cap assembly can be greatly decreased. That is, stresses generated by thermal gradients in the cap are relieved by segmenting the effusion plate as shown and removing the edge constraints. Reducing thermal stresses will serve to reduce or eliminate cracking of the effusion plate, thereby lowering repair costs of the cap and reducing the risk of damage to the downstream hot gas bath components.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

What is claimed is:

1. A combustor cap assembly comprising:

an impingement plate including a plurality of primary fuel nozzle openings arranged in a circular array about a center opening; and a combustor cap secured to a hot side of the impingement plate, the combustor cap including a plurality of cap segments independently secured to the impingement plate, wherein the plurality of cap segments are secured with cap segment edges being radially and tangentially movable relative to the impingement plate due to thermal conditions, wherein each of the plurality of cap segments comprises a fuel nozzle opening aligned with the plurality of primary fuel nozzle openings in the impingement plate and wherein the fuel nozzle openings include a collar extendable through the plurality of primary fuel nozzle openings in the impingement plate.

2. A combustor cap assembly according to claim 1 wherein the combustor cap assembly further comprises a connector securable to the collar of each of the plurality of cap segment connector pieces.

3. A combustor cap assembly according to claim 2, wherein a distal end of each collar is threaded, and wherein the connector comprises a nut.

4. A combustor cap assembly according to claim 2, wherein the connector securable to the collar of each of the plurality of cap segments is the only rigid attachment between the plurality of cap segments and the impingement plate.

5. A combustor cap assembly according to claim 1, wherein the plurality of cap segments comprise arc segments arrangeable in a circular array when secured to the impingement plate.

6. A combustor cap assembly according to claim 1, further comprising a volume formed between the impingement plate and each of the plurality of cap segments, the volume being formed by relative shapes of the impingement plate and the plurality of cap segments, the volume defining an acoustic resonator to decrease an amplitude of combustion dynamics.

7. A combustor cap cooperable with an impingement plate in a turbine fuel nozzle, the combustor cap comprising a plurality of cap segments independently securable to a hot side of the impingement plate, wherein the plurality of cap segments are radially and tangentially movable relative to the impingement plate due to thermal conditions, wherein each of the plurality of cap segments comprises a fuel nozzle opening aligned with a plurality of primary fuel nozzle openings in the impingement plate and wherein the fuel nozzle openings include a collar extendable through the plurality of primary fuel nozzle openings in the impingement plate.

8. A combustor cap assembly according to claim 7, wherein the plurality of cap segments comprise arc segments arrangeable in an array when secured to the impingement plate.

9. A combustor cap assembly comprising:

an impingement plate including a plurality of primary fuel nozzle openings arranged in an array about a center opening;

a combustor cap secured to the impingement plate and including nozzle openings aligned with the plurality of primary fuel nozzle openings in the impingement plate, the cap nozzle openings including a collar extending through the plurality of primary fuel nozzle openings in the impingement plate, wherein the combustor cap comprises a plurality of cap segments independently secured to the impingement plate, wherein the plurality of cap segments are secured such that cap segment edges are radially and tangentially movable relative to the impingement plate due to thermal conditions; and a connector secured to the collar of the cap nozzle openings securing the plurality of cap segments to the impingement plate, wherein the connector securing the plurality of cap segments to the impingement plate is the only rigid attachment between the plurality of cap segments and the impingement plate.

* * * * *